United States Patent [19]

Shireman

[11] 4,398,550

[45] Aug. 16, 1983

[54] COIN DISPENSING MECHANISM

[75] Inventor: Phillip E. Shireman, Martinsville, Ind.

[73] Assignee: Standard Change-Makers, Inc., Indianapolis, Ind.

[21] Appl. No.: 257,495

[22] Filed: Apr. 24, 1981

[51] Int. Cl.[3] ..... G07D 9/04

[52] U.S. Cl. ..... 133/1 A; 133/8 R; 133/5 R

[58] Field of Search ..... 133/1 A, 1 R, 3 E, 3 R, 133/5 R, 8 A, 8 R; 198/237; 221/174, 264, 265, 277, 237; 222/237, 238

[56] References Cited

U.S. PATENT DOCUMENTS

| | | | |
|---|---|---|---|
| 1,852,106 | 4/1932 | Chiger | 133/8 B |
| 2,551,493 | 5/1951 | Jenks | 133/5 R |
| 2,587,809 | 3/1952 | Arnett | 133/5 R |
| 2,653,850 | 11/1953 | Vollten | 133/4 X |
| 2,691,379 | 10/1954 | Foushee | 133/1 |
| 2,995,234 | 8/1961 | Seragnoli | 198/723 |
| 3,163,169 | 8/1964 | Rau | 133/1 |
| 3,612,073 | 10/1971 | Calos | 133/8 |
| 3,943,950 | 3/1976 | Thur et al. | 133/4 A |
| 3,948,279 | 4/1976 | Gupta | 133/1 R |
| 4,036,242 | 7/1977 | Breitenstein | 133/4 R |
| 4,098,280 | 7/1978 | Ristvedt et al. | 133/8 X |
| 4,123,892 | 11/1978 | Asami | 133/1 X |

FOREIGN PATENT DOCUMENTS

| | | | |
|---|---|---|---|
| 574524 | 3/1958 | Italy | 221/237 |

*Primary Examiner*—Joseph J. Rolla
*Assistant Examiner*—Jan Koniarek
*Attorney, Agent, or Firm*—Woodard, Weikart, Emhardt & Naughton

[57] ABSTRACT

Disclosed is a coin dispensing apparatus in which coins are transported by first and second plates supported for rotation in stacked, overlapping relation and are rotated by motor in opposite angular direction. Each plate carries a plurality of coin receiving apertures with the apertures in each circularly arranged about the plates axis of rotation, the locus of centers of each plate's apertures being tangent. Successive apertures in the plates move into registration as the plates rotate to permit a coin on the surface of the first plate to move into an aperture of the second plate with each registration of the plate apertures.

10 Claims, 4 Drawing Figures

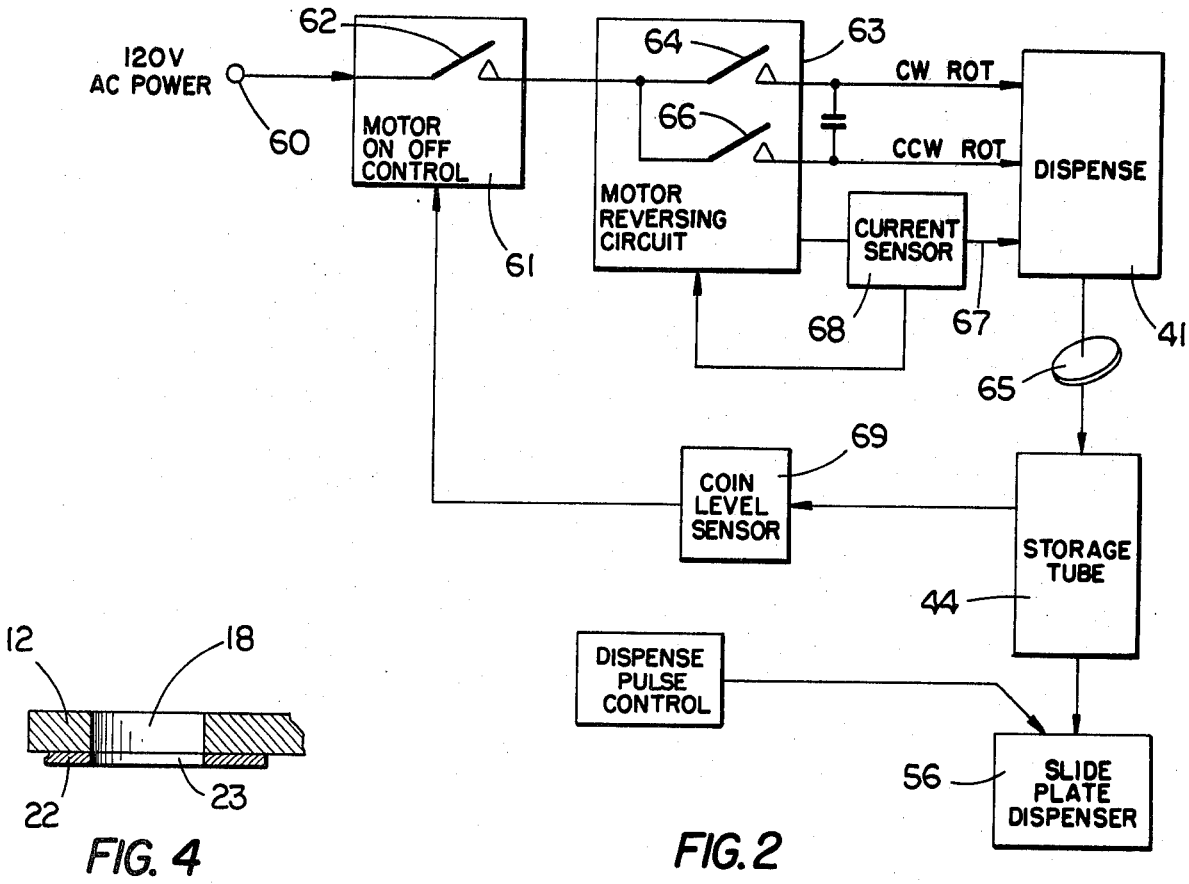
FIG. 2
FIG. 4
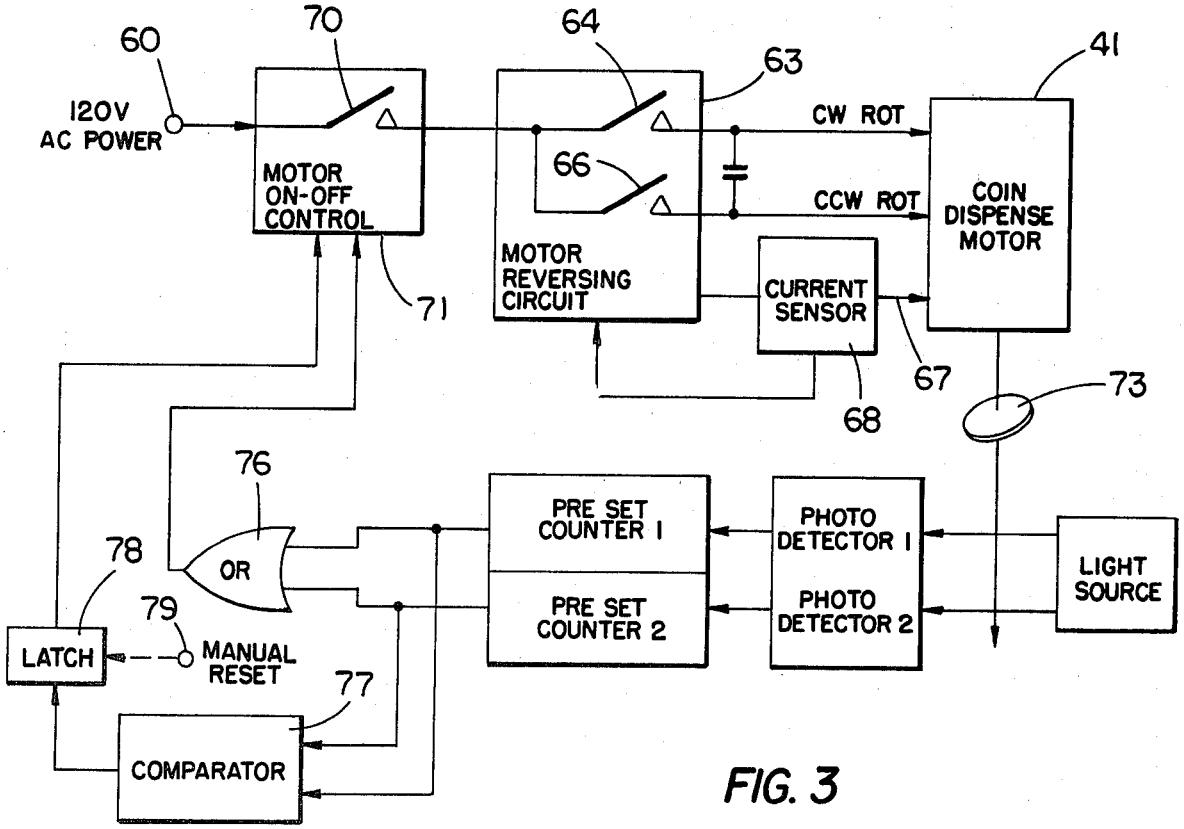
FIG. 3

COIN DISPENSING MECHANISM

BACKGROUND OF THE INVENTION

There are a large variety of coin dispensing devices on the market today and they differ widely in coin-handling methods and capacity.

Prior art patents disclosing devices of the type referred to are U.S. Pat. No. 3,948,279 in which the rotating mechanism is repeatedly de-energized, reversed in direction for a short time interval, then immediately rotated in the original direction to clear jams in the mechanism. U.S. Pat. No. 3,943,950 also discloses an anti-jamming mechanism which is temporarily reversed and then returned to its original direction of rotation. U.S. Pat. Nos. 1,852,106; 2,587,809; 2,653,850; 2,691,379; 3,163,169; 3,612,073; 4,036,242; 4,098,280 and 4,123,892 also disclose prior art coin handling apparatus.

Deficiencies in prior art devices include high complexity, noisy operation, difficulty in manual coin removal, awkward external shape, difficulty in clearing jams, heavy construction, slow dispensing rate and limited multiple coin dispense flexibility. The apparatus embodying the concept of the present invention overcomes the prior art deficiencies primarily by utilizing a design in which the overlapping coin transporting plates or discs are rotated in opposite angular direction so that, inherently, as the apertures in the plates approach and depart from momentary registration, the aperatures are moving in the same general linear direction. Because of this the "dwell" or time interval of at least partial registration of the disc apertures is increased, improving substantially the coin feed from the bulk hopper in which the coins are randomly positioned. The coin dispense rate and regularity of the coin dispenser can be further improved by thickening the uppermost of the overlapping discs to a whole integer multiple of the thickness of the coins being dispensed, thereby, in effect, permitting preloading the disc initially receiving the coins and making it unnecessary that a coin be picked up with each revolution of this disc.

The second primary design feature of the present invention is the action upon occurence of a coin jam. The rotating parts of the apparatus are symmetrical so that it will dispense coins equally well with the plates or discs rotating in either direction as long as they are rotating in *opposite angular direction* that is, counter rotating. Thus when a jam occurs, the power means receives a signal causing it to reverse the direction of rotation of both discs (they thus continue to rotate in opposite angular direction), which clears the jam. The power means then continues to rotate the discs in the new direction, continuing the transport of coins from the bulk hopper, until the next jam occurs whereupon the direction of rotation of both discs is again reversed to clear the jam. The mechanism simply continues in a given direction until the next reversal is necessary. This is in contrast to prior art devices such as those shown in U.S. Pat. Nos. 3,948,279 and 3,943,950 wherein upon occurence of a jam, rotation is momentarily reversed but then immediately returned to the original direction and this hammering action is repeated until the jam is cleared. The jam-clearing characteristic of the "either direction" operation of the present invention is much improved over the prior art and a quieter, more reliable and more power-economical unloading mechanism results.

BRIEF DESCRIPTION OF THE DRAWING

FIG. 2 is a schematic, circuit diagram illustrating a preferred, alternate means for controlling the dispensing apparatus which does not use the mechanical coupling and switch actuating lever of FIG. 1.

FIG. 3 is a schematic circuit diagram illustrating the preferred electrical form of control (as contrasted with the mechanical form of FIG. 1) but eliminating the use of a coin storage tube.

FIG. 4 is an enlarged, fragmentary, side sectional view of a modified form of the rotating, apertured discs shown in FIG. 1.

DESCRIPTION OF THE PREFERRED EMBODIMENTS

Figure 1:
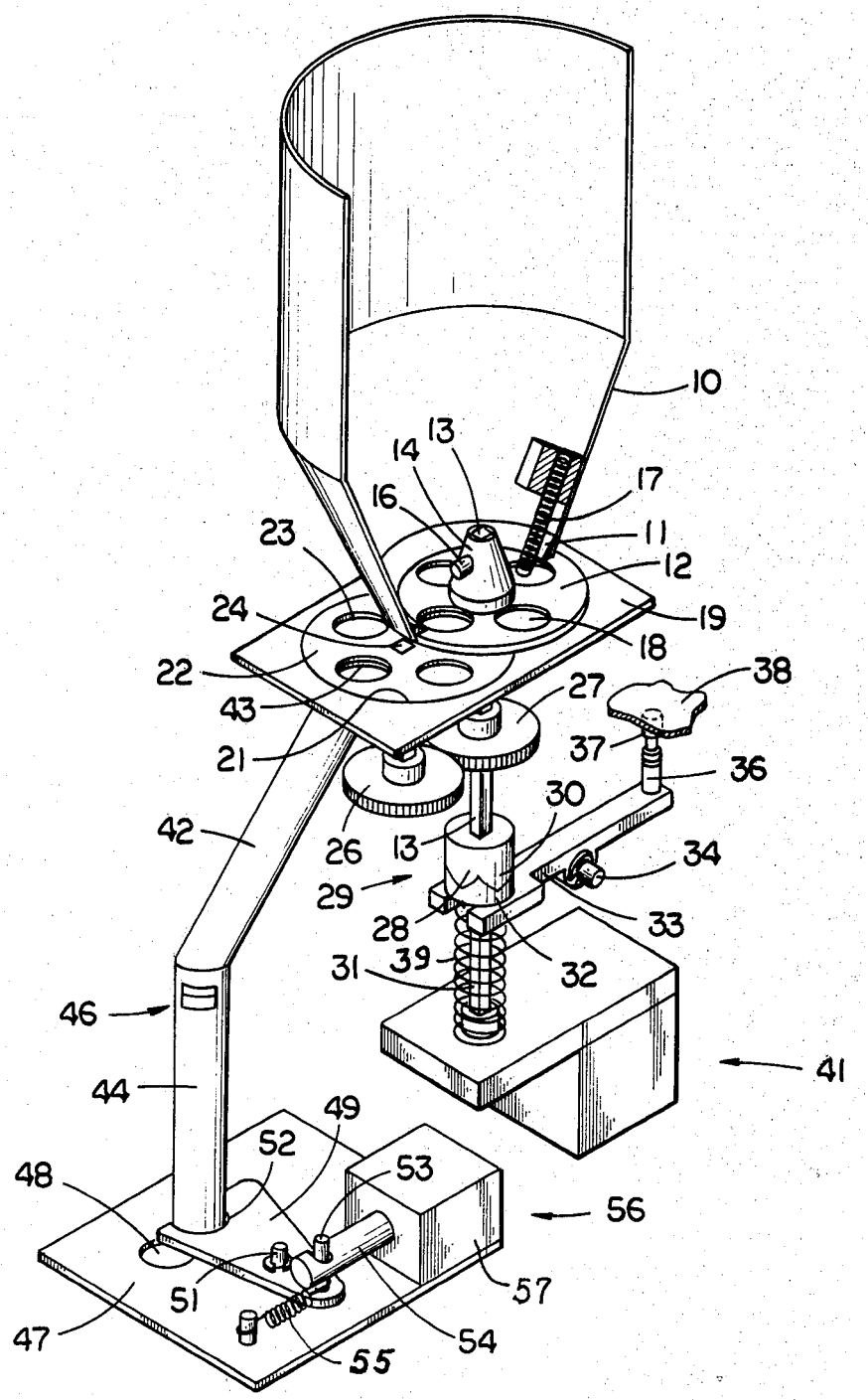
FIG. 1 is a perspective view of apparatus embodying the present invention.

Referring initially to FIG. 1, there is shown a frustoconically shaped coin container or bulk hopper 10 which may contain randomly positioned coins (not shown). An inclined ring 11 borders the smaller-diameter, lower end of the hopper and overlies a primary plate or disc 12. Disc 12 is supported for rotation on a shaft 13 which extends above the plate and underlies a conical, coin-deflector member 14 having knock-down pins 16 for knocking over coins positioned vertically on the disc. A flexible member 17 carried by a block mounted on the inner, side surface of hopper 10 extends to a point adjacent the upper surface of disc 12 and functions to prevent coins from riding around on the disc when the number of coins in the hopper is low. The flexible member 17 could, additionally, be used as a coin level sensor for shutting down the dispenser automatically when the coin level in hopper 10 is low. This can be accomplished by applying a low level voltage to the flexible member after insulating its mounting from the dispenser chassis. With coins above the minimum level, the coins would complete the circuit between the flexible member and the chassis (ground) and the dispenser would operate normally. When the coin level is low, so that coins fail to complete the circuit, the apparatus would be deenergized.

The lower end of the hopper is closed by disc 12. The disc has a plurality of coin receiving apertures 18 therein which are adapted to receive coins from the hopper. A stationary back-up plate 19 underlies disc 12 and is provided with a circular recess 21 which freely accommodates the secondary plate or disc 22. The secondary disc also is provided with a plurality of coin receiving apertures 23. The disc 22 is supported for rotation within recess 21 by means of stub shaft 24 which, at its lower end, carries a driven gear 26. It should be noted that the apertures in each of the plates 12 and 22 are circularly arranged about the center and axis of rotation of each plate and that an imaginary circular line joining the centers of the apertures in disc 12 is tangent to a circular line joining the centers of the apertures in disc 22.

A spur gear 27 is rigidly secured to shaft 13 and meshes with driven gear 26. The arrangement is such that no matter which direction shaft 13, and consequently disc 12, is driven, shaft 24, and consequently disc 22 will be counter rotated, that is, the discs will rotate in opposite angular direction. However, as will be evident from FIG. 1, as the apertures 23 move into and out of sequential registration, the apertures approaching and departing registration, the aperatures in the overlapping portion of the two discs, will be moving in the same general linear direction.

One, generally mechanical control means for controlling the motion of the discs will now be described. The shaft 13 carries a portion 28 of a separable coupling 29 and an axially aligned drive shaft 31 carries the other portion 32 of the coupling. Coupling portion 32 is rotationally locked to shaft 31 but can freely slide along its length. The engaging faces of the coupling portions are provided with matching angular projections or teeth 30 and coupling portion 32 engages a bifurcated lever arm 33 which is centrally pivoted on pin 34. The opposite end of the arm carries a member 36 which cooperates with an alternate action switch 37 mounted on a depending, stationary plate shown fragmentarily at 38.

A compression spring 39 urges the coupling portions into engagement but yields to permit movement of coupling portion 32 downwardly, as viewed in FIG. 1, when a coin jam at plates 12 and 22 halts rotation of the gears. Drive shaft 31 is rotated by a reversible gear motor indicated generally at 41. The anti-coin jam structure just described could be utilized with various coin metering devices but is here shown with an inclined coin chute 42 which has its open, upper end disposed at a drop-through aperture 43 in the plate 19, the aperture 43 being located outside the overlapping portion of discs 12 and 22. The aperture 43 registers, sequentially, with the apertures 23 as disc 22 rotates in either angular direction. The inclined chute 42 is joined to a vertical storage tube 44 which may have mounted thereon a coin level sensor, such as a photo-electric cell, indicated generally at 46. The storage tube 44 terminates at approximately coin-thickness distance above the stationary base plate 47 of a coin dispenser control 56. Positioned to one side of the tube end is a coin-receiving aperture 48 through which coins are dropped to the point of customer access. The coins are dispensed, one-by-one, off the bottom of tube 44 by means of a slide plate dispenser or dispensing arm 49, the arm being pivoted at 51. The arm is provided with a cutaway portion 52 accommodating the lowermost coin of the stack supported in tube 44. A pin 53, extending from arm 49 is received in a slot in the plunger 54 of an electrical solenoid 57. A tension spring 55 returns the arm to its position shown in FIG. 1 after each inward movement of plunger 54 which occurs with each momentary energization of solenoid 57 which may receive controlling pulses from a dispense pulse control.

A source of electrical power may be connected through coin sensing switch 46 to the alternate action switch 37, previously described. The reversible motor 41 is energized to rotate drive shaft 31 in the direction signalled to switch 37 by movement of arm 33. The coin sensor 46 functions to keep tube 44 full of coins by turning gear motor 41 on and off.

In operation, with randomly positioned coins in the container 10, a coin will fall in an aperture 23 in disc 22 each time the aperture 23 registers with an aperture 18 in disc 12 and, most importantly, this will occur no matter which angular rotational direction the gear 27 is rotated. As the apertures 18 and 23 approach and retreat from full registration, they will be moving in the same general linear direction so that, as previously mentioned, dwell time for depositing a coin will be prolonged enhancing the efficiency of coin transfer. Further movement of disc 22 deposits the coin in chute 42 from whence it may be dispensed by the arm 49, controlled by solenoid 56.

Should a coin jam occur at the junction of the discs 12 and 22, rotation of shaft 13 will be impeded or blocked. This will cause coupling portion 32 to move downwardly, as viewed in FIG. 1, pivoting arm 33 and providing a reverse direction signal to switch 37 controlling the direction of rotation provided to shaft 31 by gear motor 41. The coupling portions will thereupon snap back into engagement and shaft 13, together with discs 12 and 22 will rotate in a direction opposite to their original direction until the next jam occurs, whereupon the cycle is repeated. There are no repeated attempts to back off the rotating part of the mechanism and then repeatedly hammer it forward in the original direction as is characteristic of prior art jam clearing schemes. The symmetrical arrangement of the discs and apertures enables operation of the rotating parts in either direction.

While a mechanical switching arrangement has been described herein for controlling motor 41, a preferred, alternate form of control for the reversing mechanism, utilizing an electronic logic circuit, will now be described with reference to FIG. 2.

It will be understood that the motor reversing logic circuit now to be described replaces the mechanical arrangement (separable coupling 29, lever 33 and switch 37) of FIG. 1. The circuit includes a source of 120 volt A.C. power 60 and a motor on-off component 61 including switch 62. Also a motor reversing component 63 including switch 64 controlling, for example, the clockwise rotation winding of the dispensing motor 41. Likewise a switch 66 controls the counterclockwise rotation winding of the reversible motor 41. The common wire 67 to the motor incorporates an electrical current sensor 68 which controls component 63 and, thus, switches 64 and 66. The magnitude of the current flow in the motor common wire 67 is sensed by sensor 68 and when the drive motor 41 is stopped by a jammed coin, the current in motor lead 67 will immediately rise to approximately double its normal running value. If, at the instant the current increases, switch 64 is closed and switch 66 is open, the motor reversing circuit will open switch 64 and close switch 66, causing motor 41 to reverse its direction of rotation. The rotation reversal at discs 12 and 22 (FIG. 1) will cause the coin to be released and the jam cleared. The motor control circuit component 63 will, however, cause switch 64 to remain open and switch 66 closed even though the current sensor 68 indicates the current in wire 67 has fallen back to a normal operating level (after the jam has cleared). This counterclockwise rotation will continue until the current in wire 67 again increases to an abnormal value indicating another coin jam at discs 12 and 22. The cycle will then be repeated. The coin level sensor, by controlling motor on-off switch component 61, and hence switch 62, functions to maintain the coins in the storage tube 44 at the desired level. A coin moving into the storage tube is schematically represented at 65.

FIG. 3 discloses a logic circuit the same as the circuit of FIG. 2 with respect to control of the direction of rotation of motor 41 but with a modified control of the motor on-off switch 70 and switch control component 71 so that no temporary coin storage function (such as provided by tube 44) is necessary. Components identical with those of FIG. 2 are given the same reference numeral identification as in FIG. 2. The coin dispense motor 41, it will be understood, in this direct-dispense form of the apparatus is located closely adjacent the hopper (10 in FIG. 1) and counter-rotates the discs 12 and 22 of FIG. 1. The anti-jam reversal of rotation is triggered by motor current sensor 68 as in the arrangement of FIG. 2. Dispensing of coins is direct from the hopper to the change cup. As the coins (indicated schematically at 73) leave the hopper they are counted by redundant photoelectric cells indicated as photodetectors 1 and 2. When the count of coins reaches an amount preset into the dual counters 1 and 2, the preset amount being reached on either or both counters, the OR-gate 76 provides a signal to the on-off motor control 71 resulting in opening of the dispense motor switch 70, stopping the dispense motor 41. With the next call for coins, the cycle is repeated.

When all the components are functioning properly, the comparator 77 sees the same count on both of the channels to which it is connected. If the comparator sees a differing count on one or the other of the two channels, it provides a signal which sets a latch at a latch component 78. The latch causes the motor on-off control 71 to open switch 70 deenergizing coin dispense motor 41. A manual reset operation, indicated schematically at 79, must be performed to reset the latch to permit resumption of operation of the motor.

A modified form of the primary plate or disc 12 is shown in FIG. 4. It has been found that if the thickness of disc 12 adjacent the apertures 18 is increased to a whole integer multiple of the nominal thickness of the coins being dispensed, a greatly improved dispensing rate for the apparatus can be achieved. For example, as shown in FIG. 4, if the thickness of disc 12 is four times the nominal coin thickness (with lower disc 22 being retained at nominally one coin thickness), then the four-apertured disc 12 could hold up to sixteen coins. This would permit four revolutions of the disc before any aperture would be emptied, even if no additional coins were picked up from hopper 10. In actual operation, this has an averaging effect on the coin pick-up rate (theoretically the thickened disc 12 could pick up as many as sixteen coins on one revolution or as few as zero) which greatly enhances the dispense rate and regularity of the coin dispenser. The design requirement for disc 12 is that its thickness be a whole integer multiple of the coins' thickness, while the thickness of plate 22 is retained at a single coin thickness. A limit for the thickness of plate 12 is reached when its thickness causes coins to become wedged on edge in the apertures, blocking off the apertures and preventing transfer of coins from disc 12 to disc 22.

While the invention has been illustrated and described in detail in the drawings and foregoing description, this is to be considered as illustrative and not restrictive in character, it being understood that only the preferred embodiment has been shown and described and that all changes and modifications that come with the spirit of the invention are intended to be protected.

I claim:

1. Coin dispensing apparatus including first and second plates supported for rotation in stacked overlapping relation, power means for rotating said plates in opposite angular direction about parallel axes normal to the plane of each plate, a plurality of coin receiving apertures formed in each of said plates with the apertures in each plate arranged equidistant from the respective axis of rotation of the plate, the circles formed by a line joining the aperture centers in said plates being tangential, whereby successive apertures in said plates move into registration as the plates rotate to permit a coin in one of the apertures of said first plate to move into one of the apertures of said second plate with each registration of said plate apertures, and which means are provided for sensing the occurrence of a rotation-impeding coin jam at the interface of said plates and providing a signal to said power means reversing the previous direction and continuing rotation of said plates in the reversed direction until the next jam occurrence sensed by said means provides a signal to said power means again causing reversal and continuing rotation of said plates in the new direction.

2. The coin dispensing apparatus of claim 1 in which the thickness of said first plate bordering its coin receiving apertures is substantially equal to a whole integer multiple of the thickness of the coins being dispensed.

3. Coin dispensing apparatus including first and second plates supported for rotation in stacked overlapping relation, power means for rotating said plates in opposite angular direction about parallel axes normal to the plane of each plate, a plurality of coin receiving apertures formed in each of said plates with the apertures in each plate arranged equidistant from the respective axis of rotation of the plate, the circles formed by a line joining the aperture centers in said plates being tangential, whereby successive apertures in said plates move into registration as the plates rotate to permit a coin in one of the apertures of said first plate to move into one of the apertures of said second plate with each registration of said plate apertures, and including a control means for controlling the transfer of rotary motion from said power means to said plates, said control means including switching means for reversing the direction of rotation of said plates upon the occurrence of a rotation-blocking coin jam at the interface of said plates and subsequently maintaining said reverse rotation until the next jam whereupon rotation of said plates is again reversed.

4. The coin dispensing apparatus of claim 3 in which said power means is a reversible electric motor and said control means senses a coin jam by utilizing the resulting abnormal current rise in the stalled reversible motor to thereupon reverse the direction of rotation of said motor and consequently said plates and subsequently maintain said reverse rotation until the next jam whereupon rotation of said plates is again reversed.

5. The coin dispensing apparatus of claim 3 in which said control means senses a coin jam by means of driving and driven clutch members having mating toothed faces spring biased into engagement but moved axially out of engagement upon a coin jam at said rotating plates, and a motion transfer member for transferring the said axial motion to said switching means.

6. The coin dispensing assembly of claim 3 having a preset counter component which provides a signal to said power means halting its operation after the preset number of coins fall through the registering apertures in said plates.

7. The coin dispensing assembly of claim 6 in which said counter component is in dual channel form and in which a comparator and a latch component are provided to latch open until reset the energizing circuit to said power means whenever the counts seen by said comparator component in each of said dual channels are other than equal.

8. A coin dispensing assembly comprising a frusto-conical hopper containing randomly positioned coins, a circular primary plate forming the lower lesser-diameter end of said hopper, said primary plate being supported for rotation about an axis normal to the plate of the plate, a secondary plate supported for rotation on an axis parallel to that of said primary plate and disposed in partial underlying relation to said primary plate, power means for rotating said plates in opposite angular direction, multiple coin receiving apertures formed in each of said plates with the apertures in each plate arranged equidistant from the respective axis of rotation of its respective plate, the circles formed by a line joining the aperture centers in said plates being tangential, a coin chute having its open upper end disposed adjacent the underface of said secondary plate for receiving coins in stacked relation dropped through the apertures in the secondary plate as they register wih the chute, a dispenseing plate movably supported adjacent the open lower end of said chute for displacing the stacked coins one-by-one sidewardly from said open end of the chute, and means connected to said power means for reversing the direction of rotation of said primary plate and said secondary plate upon the occurrence of a rotation blocking coin jam at the interface of said primary plate and said secondary plate and subsequently maintaining the reverse rotation until the next jam whereupon the rotation is again reversed.

9. The coin dispensing assembly of claim 8 in which a stationary back-up plate underlies said rotating plates and has an inwardly off-set portion receiving said secondary plate, said back-up plate being provided with an aperture registering with said open upper end of the coin chute.

10. The coin dispensing assembly of claim 8 in which a stationary base plate is mounted in closely spaced relation to the discharge end of said coin chute, and said dispensing plate is mounted on said base plate and is moveable into the space between the coin chute discharge end and said base plate for edge-engaging coins at the discharge end of said coin chute and displacing them one-by-one from alignment therewith.

* * * * *